United States Patent [19]

Lemarquand et al.

[11] Patent Number: 4,605,918

[45] Date of Patent: Aug. 12, 1986

[54] HIGH SPEED CURRENT MAXIMUM TRIPPING DEVICE

[75] Inventors: Pierre Lemarquand; Luc Moreau, both of Dijon, France

[73] Assignee: La Telemecanique Electrique, France

[21] Appl. No.: 713,944

[22] Filed: Mar. 20, 1985

[30] Foreign Application Priority Data

Mar. 20, 1984 [FR] France ..... 84 04260

[51] Int. Cl.[4] ..... H01F 7/08

[52] U.S. Cl. ..... 335/261; 335/279

[58] Field of Search ..... 335/251, 255, 261, 262, 335/279

[56] References Cited

U.S. PATENT DOCUMENTS

| | | | |
|---|---|---|---|
| 2,992,304 | 7/1961 | Andrews | 335/261 |
| 3,593,240 | 7/1971 | Garczynski | 335/261 |
| 4,491,816 | 1/1985 | Blum | 335/261 |

*Primary Examiner*—George Harris

*Attorney, Agent, or Firm*—William A. Drucker

[57] ABSTRACT

A high speed current maximum tripping device, comprising a fixed core and a mobile core with complementary shapes and disposed in the same plane while defining an air gap therebetween. The fixed and mobile cores are obtained by flat stamping and have complementary profiles of a generally curvilinear shape with sides whose slope with respect to the main axis of the projecting core increases progressively from the nose towards the body.

10 Claims, 9 Drawing Figures

HIGH SPEED CURRENT MAXIMUM TRIPPING DEVICE

BACKGROUND OF THE INVENTION

1. Field of the Invention

The invention relates to high speed tripping devices used in small apparatus providing protection against short circuits. These devices comprise a coil associated with a magnetic circuit having a yoke, a fixed core and a low inertia mobile core for mechanically controlling the break of the associated protection apparatus, these cores being separated by an air gap placed in the region of maximum flux.

2. Description of the Prior Art

It is known to form such tripping devices with a flat mobile core so as to reduce the thickness of the associated protective device. However, these devices need to be improved as far as their simplicity and manufacturing costs are concerned.

Moreover, it is desirable to obtain in a high speed trip a substantially constant force of attraction as a function of the variation between the fixed core and the mobile core; now, in known tripping devices, this constant level of the force of attraction cannot be obtained because of the presence, on the side of the cores, of walls parallel to the direction of movement of the mobile core; or else it can only be obtained at the price of complex arrangements. The aim of the present invention is especially to optimize in a very simple manner the evolution of the force of attraction produced between the fixed core and the mobile core as a function of their air gap. Another aim is to facilitate the construction, with a saving of space and reduced cost, of a high speed tripping device for a protection apparatus of small thickness.

SUMMARY OF THE INVENTION

According to the invention, this result is reached in a device of the type described in the preamble because the two cores are obtained by flat stamping and have complementary profiles of a general curvilinear shape, that one of the two cores which is projecting having a nose and a body, the nose being connected to the body by sides whose slope with respect to the main axis of the projection core increases progressively from the nose towards the body.

The core with projecting nose thus has one end relatively tapered along a main axis and inscribed within a triangle whose base has a dimension equal to the width of the body of the core and whose height extends substantially along the main axis of the core.

The result is that, when the air gap decreases during actuation of the tripping device, the force of attraction between the cores remains substantially constant within a wide range because of the progressive variation of the slope of their sides, the variation of this slope being for example about 5° near the nose and 90° near the body of the projecting core. The absence on each core of sides parallel to their main axis results in removing from the force/air gap curve any bump prejudicial to the acceleration of the mobile core.

The end of the nose of the projection core may have a width—and/or the curvilinear sides of this core may have faces cut to a length—at least equal to the thickness of the metal sheet from which the core is stamped.

The fixed core may advantageously have at least one flat which is accomodated in a corresponding opening in one face of the yoke or of the protection apparatus, whereas the mobile core is mounted in an oblong guide window formed in a parallel face of the yoke.

When the yoke has a U shape, the stamped fixed core forms for example a flux closure bridge whose ends form the supporting flat portions.

BRIEF DESCRIPTION OF THE DRAWINGS

The advantages and features of the invention will be clear from the following description.

In the accompanying drawings.

DESCRIPTION OF THE PREFERRED EMBODIMENTS

Figure 1:
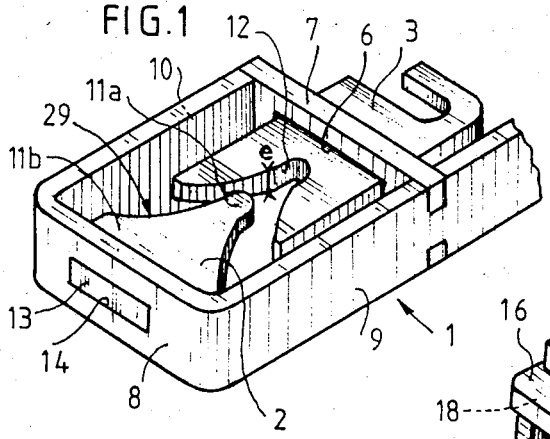
FIG. 1 shows in a perspective view the magnetic circuit of a tripping device according to a first embodiment of the invention.

The tripping device shown in the Figures comprises a magnetic circuit with yoke 1, for example made from electrolytic copper coated steel or from colaminated steel and copper, and a flat mobile core 3, as well as a flat fixed core 2, having complementary profiles obtained by stamping and situated in the same plane.

The mobile core 3 plays the role of high speed magnetic tripping member capable of acting, depending on the current flowing in a coil 4 supported by an insulating sleeve-shaped carcase 5, on a protection apparatus not shown through a transmission mechanism also not shown.

Figure 3:
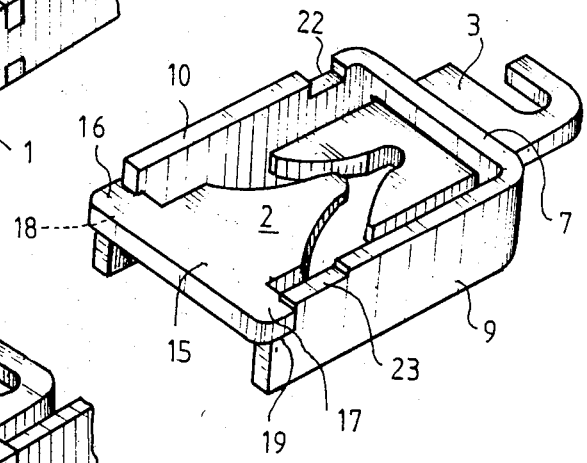
FIGS. 2 to 5 illustrate variants.
Figure 4:
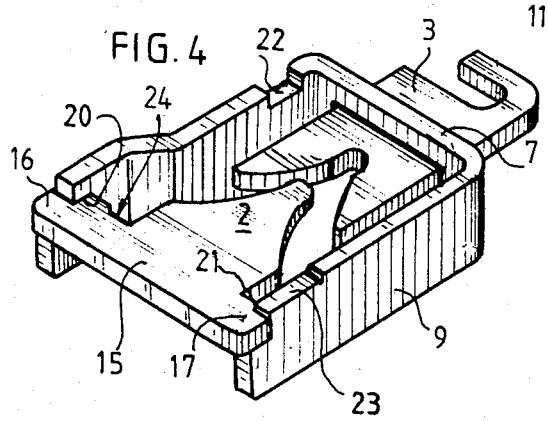

The mobile core is accomodated so as to be able to slide in a window 6 formed in a branch 7 of the yoke, this latter further having, depending on the cases, an opposite parallel branch 8 and two side branches 9, 10 (FIGS. 1 and 2) or only two side branches 9, 10 (FIGS. 3 and 4). In all cases, the fixed core 3 has one end in the form of a nose or nipple 11*a*, a body 11*b* and a special curvilinear profile connecting the nose to the body whose role, in connection with a recess 12 having a profile complementary to that of the mobile core 3, will be explained further on. It goes without saying that the projecting core here represented by the fixed core may also be formed by the mobile core; the two cores could also be mobile.

Figure 2:
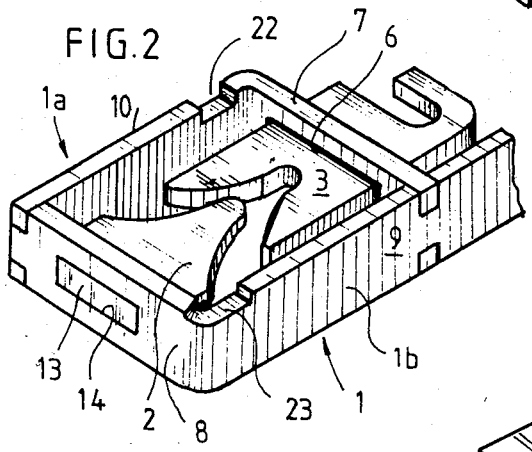

In the embodiments shown in FIGS. 1 and 2, the fixed core 2 is engaged and fixed by means of a flat portion 13 in a window 14 in branch 8 of the yoke, this latter therefore has a U shape closed by branch 7 formed by a bar fitted and crimped onto branches 9, 10 (FIG. 1) or is formed from two L shapes, 1*a*, 1*b*, fitted together and one comprising branches 7, 10, while the other comprises branches 8, 9 (FIG. 2).

In the embodiments shown in FIGS. 3 and 4, the yoke is formed from a single U shaped piece having three branches 7, 9, 10; the fixed core 2 has, at its rear part, a flux closure bridge 15 with two lateral flat portions 16, 17 for fixing core 2 by welding to shoulders 18, 19 (FIG. 3) or by crimping and/or welding in slots 20, 21 (FIG.

4), the shoulders or the slots being stamped out at the ends of the branches 9, 10 of the stamped yoke 1.

A notch 22 is provided in branch 10 of the yoke for passing a wire for connecting the coil 4 and, in branch 9 of the yoke, a notch 23 for passing the other connecting wire of the coil. In the embodiment shown in FIG. 4 the first connecting wire is soldered to notch 22 and the corresponding branch of the yoke plays the role of support for the fixed contact of the protection apparatus, in which the support, not shown, for the mobile contact cooperates directly with the outer face of branch 9; the lead-out from the coil through notch 23 is obviously insulated. Notches such as 24 are provided in the fixed core 2 for facilitating positioning of coil 4 and its carcase 5.

Figure 5:
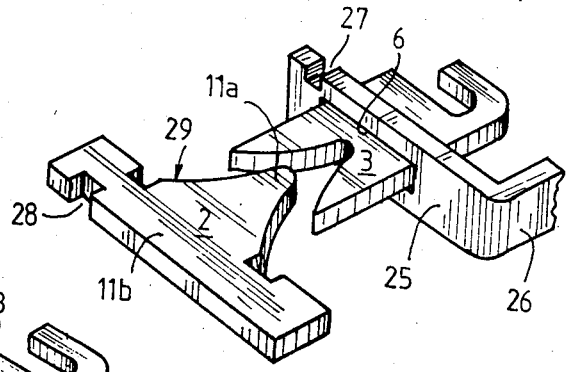

In the embodiment shown in FIG. 5, the carcase of the coil and the fixed core 2 are supported by an insulating piece not shown possibly molded with the protection apparatus, and yoke 1 has a simplified L shape one of whose branches 25 comprises the window 6 for guiding the mobile core 3 and the other branch 26 of which serves as a support for the fixed contact of the protection apparatus. One of the connection wires may be soldered to branch 25 of the yoke 27, the other to a notch 28 formed in the fixed core.

Figure 6:
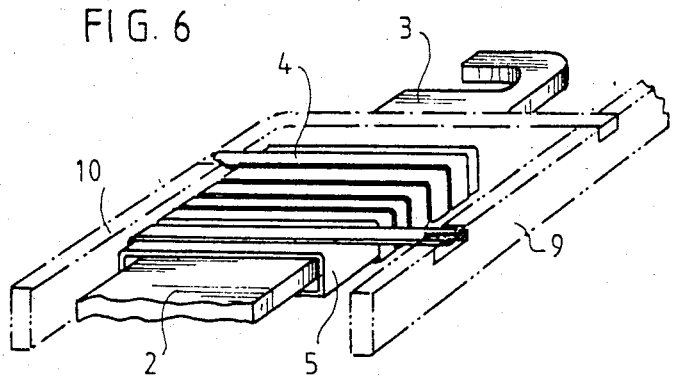
FIG. 6 shows schematically the arrangement of the coil.

It can be seen in FIG. 6, that the coil 4 made from flat wire and supported by the insulating carcase 5 is placed about cores 2, 3 and passes through the gap formed between these latter and the side branches 9, 10 of the yoke.

It is clear that the embodiments described are simple to produce and may advantageously have a small thickness. The flat shape of the fixed and mobile cores increases the perimeter around which the eddy currents flow, so reduces their intensity and their disturbing effect, resulting in an increase in tripping speed.

Figure 7:
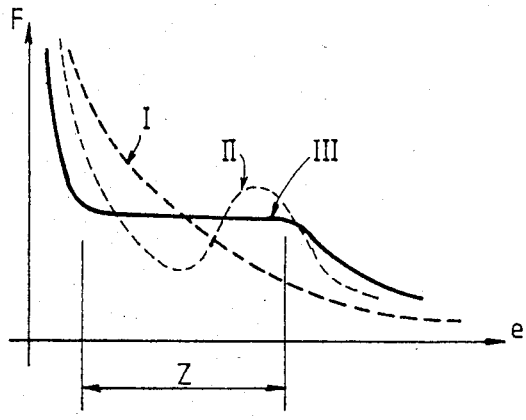
FIG. 7 shows different curves illustrating the variation of the force of attraction as a function of the air gap.
Figure 8:
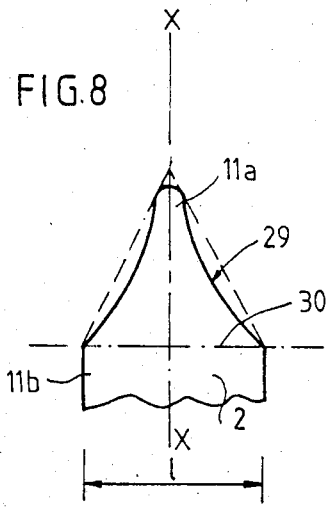
FIGS. 8 and 9 show in a front view the end of the projecting fixed core in one of the preferred embodiments.

With an optimum stamped shape for the cores, the tripping device may be given the characteristics shown in FIG. 7 which illustrates the force of attraction F as a function of the air gap "e". With respect to a broken line curve I relative to a conventional tripping device with triangular section core or a broken line curve II relative to a core a part of whose sides is parallel to the axis, the full line curve III obtained with the tripping device of the invention produces a working zone Z having a substantially constant force. A preferred profile of the end of the fixed projecting core 2 is shown in FIG. 8 where nose 11*a* can be seen connected to the body 11*b* of the core by a profile with curvilinear sides 29; this profile is inscribed within a triangle whose base 30 has a dimension equal to the width "1" of the core and whose height extends along the main axis XX of the core.

Figure 9:
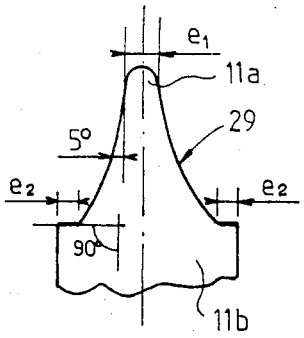

As illustrated in FIG. 9, the slope of the curvilinear sides 29 connecting nose 11*a* to the body 11*b* of the projecting core increases progressively from about 5° to about 90° from the nose towards the body; the width "$e_1$" of the end of nose 11*a* is at least equal to the thickness "e" of the metal sheet from which the core is stamped; similarly, width "$e_2$" having cut faces at the base of the curvilinear sides 29 is at least equal to the thickness "e" of the metal sheet.

The force and acceleration imparted to the mobile core during actuation of the tripping device are thus made substantially constant over a wide range, using extremely simple arrangements.

It goes without saying that modifications may be made to the embodiments described without departing from the scope and spirit of the invention.

What is claimed is:

1. In a high speed current maximum tripping device for an apparatus providing protection against short circuits, comprising a coil associated with a magnetic circuit having a yoke and two cores one at least of which is mobile for controlling the break of the protection apparatus, the cores having complementary shapes and being disposed in the same plane while defining therebetween an air gap, said two cores are obtained by flat stamping and have complementary profiles of a generally curvilinear shape, that one of the two cores which is projecting comprising a nose and a body, the nose being connected to the body by sides whose slope with respect to the main axis of the projecting core increases progressively from the nose towards the body.

2. The device as claimed in claim 1, wherein said core with projecting nose has one end inscribed inside a triangle whose base has a dimension equal to the width of the body of the core and whose height extends substantially along the main axis of the core.

3. The device as claimed in claim 1, wherein the progressive variations of the slope of the curvilinear sides of the projecting core is provided in a range between about 5° near the nose and 90° near the body of the core.

4. The device as claimed in claim 1, wherein the end of the nose of the projecting core has a width at least equal to the thickness of the metal sheet from which the core is stamped.

5. The device as claimed in claim 1, wherein the curvilinear sides of the core have, at the connecting point with the body of the core, cut faces of a length at least equal to the thickness of the metal sheet.

6. The device as claimed in claim 1, wherein the fixed core has at least one flat portion which is accomodated in a corresponding opening in one face of the yoke or of the protection apparatus, whereas the mobile core is mounted in a parallel face of the yoke.

7. The device as claimed in claim 6, wherein the yoke has a U shape, the flat fixed core forming a flux closure bridge whose ends form the flat portions for engagement on shoulders or in slots in the side branches of the yoke.

8. The device as claimed in claim 7, wherein one of the side branches of the U shaped yoke is electrically connected to one of the connection wires of the coil and forms the support for the fixed contact of the protection apparatus.

9. The device as claimed in claim 6, wherein the yoke has the shape of an L one of whose legs has the guide window for the mobile core and whose other leg forms the support for the fixed contact of the protection apparatus and is electrically connected to one of the connection wires of the coil, whereas the fixed coil is isolated from the L shaped yoke, forms the support for the carcase of the coil and is electrically connected to the other connection wire of the coil.

10. An apparatus providing protection against short circuits comprising the high speed tripping device as claimed in claim 1.

* * * * *